US005405057A

United States Patent [19]

Moore

[11] Patent Number: 5,405,057

[45] Date of Patent: Apr. 11, 1995

[54] MANUALLY ACTUATED PUMP

[76] Inventor: David G. Moore, Rte. 67, Box 474, Roach, Mo. 65787

[21] Appl. No.: 139,168

[22] Filed: Oct. 21, 1993

[51] Int. Cl.[6] ..... B67B 5/00

[52] U.S. Cl. ..... 222/153.14; 222/321.9

[58] Field of Search ..... 222/153, 321, 384; 239/333

[56] References Cited

U.S. PATENT DOCUMENTS

| | | | |
|---|---|---|---|
| 2,598,308 | 5/1952 | Samuels et al. . | |
| 3,062,416 | 11/1962 | Cooprider | 222/321 |
| 3,248,021 | 4/1966 | Corsette . | |
| 3,422,996 | 1/1969 | Lipman . | |
| 3,500,761 | 3/1970 | Clevenger et al. . | |
| 3,583,605 | 6/1971 | Corsette | 222/321 |
| 3,608,788 | 9/1971 | Tanaka . | |
| 3,729,120 | 4/1973 | Sette et al. . | |
| 4,057,176 | 11/1977 | Horvath . | |
| 4,162,746 | 7/1979 | Anderson et al. . | |
| 4,340,158 | 7/1982 | Ford et al. . | |
| 4,410,107 | 10/1983 | Corsette . | |
| 4,458,832 | 7/1984 | Corsette | 222/384 X |
| 4,496,082 | 1/1985 | Corsette | 222/384 X |
| 4,496,085 | 1/1985 | Ford . | |
| 4,887,744 | 12/1989 | Williams . | |
| 4,960,230 | 10/1990 | Marelli . | |
| 4,991,746 | 2/1991 | Schultz . | |
| 5,000,347 | 3/1991 | Tran . | |
| 5,025,956 | 6/1991 | Linsenbigler . | |
| 5,246,150 | 9/1993 | Delia . | |

FOREIGN PATENT DOCUMENTS

| | | |
|---|---|---|
| 0256639 | 2/1988 | European Pat. Off. . |
| 0390717 | 10/1990 | European Pat. Off. . |
| 0528665 | 2/1993 | European Pat. Off. . |
| 1415269 | 12/1965 | France . |
| 2300916 | 9/1976 | France . |
| 0328427 | 8/1989 | France . |
| 1625205 | 7/1970 | Germany . |
| 2429988 | 1/1975 | Germany . |
| 3011937 | 10/1980 | Germany . |
| 3249769 | 7/1983 | Germany . |
| 8303136 | 7/1983 | Germany . |
| 3225910 | 1/1984 | Germany . |
| 3404672 | 8/1984 | Germany . |
| 3406438 | 8/1984 | Germany . |
| 3340869 | 5/1985 | Germany . |
| 8531330 | 4/1986 | Germany . |
| 3715300 | 11/1988 | Germany . |
| 3829395 | 3/1989 | Germany . |
| 4005094 | 9/1990 | Germany . |
| 8905137 | 10/1990 | Germany . |
| 4115774 | 11/1992 | Germany . |
| 2122692 | 1/1984 | United Kingdom . |
| 2134988 | 8/1984 | United Kingdom . |

*Primary Examiner*—Gregory L. Huson
*Attorney, Agent, or Firm*—Frijouf, Rust & Pyle

[57] ABSTRACT

An apparatus is disclosed for an improved manually actuated pump for dispensing a liquid within a container comprising a pump body having an internal pump cylinder secured to the container. A piston is slidably disposed within the internal pump cylinder of the pump body with a pump stem having a stem end extending external the pump body. The stem end supports an actuator having a nozzle communicating with an internal stem passage of the pump stem for discharging the liquid from the container through the nozzle. A lock comprises a projection extending radially outward from the pump stem and an overhang extending radially inwardly relative to the internal pump cylinder of the pump body for preventing movement of the actuator in either an extended position or a retracted position upon rotation of the pump stem.

19 Claims, 6 Drawing Sheets

MANUALLY ACTUATED PUMP

BACKGROUND OF THE INVENTION

1. Field Of The Invention

This invention relates to dispensing and more particularly to a manually actuated pump for dispensing a liquid having a manual actuator. More particularly, this invention relates to a manually actuated pump having an actuator movable between an extended position and a retracted position with means for preventing the movement of the actuator in either the extended position or the retracted position.

2. Background of the Invention

Hand operated pumps have become more popular in recent years to dispense a wide variety of products such as cleaning products, lubricating products, personal care products and the like. In a typical manually actuated pump, the pump comprises a pump body defining an internal pump cylinder for receiving a reciprocating piston slidably disposed within the internal pump cylinder. The manually operated pump is secured to a container for receiving liquid from the container through an eduction tube. A pump stem extends from the pump body for engaging with the piston with a spring biasing the piston and the pump stem into an extended position. An actuator is secured to the pump stem for enabling an operator to reciprocate the piston. A plurality of one-way valves are disposed within the pump body for enabling the liquid internal the container to be dispensed from a terminal orifice upon reciprocation of the actuator between the extended position and a retracted position.

Typically, two types of actuators have been used in the prior art for reciprocating the pump stem between the extended and the retracted position. The first type of actuator is commonly referred to as a finger pump wherein the pump stem is reciprocated by the index finger of an operator. The second type of actuator is commonly referred to as a trigger pump wherein a trigger is pivotally mounted relative to the pump body to reciprocate the pump stem by the fingers of an operator.

It has been found that in certain circumstances, especially in finger operated pumps, it is desirable for the pump stem to be locked to inhibit dispensing of the manual operated pump during shipping or the like. Various means have been devised in the prior art for locking the pump stem in the extended position upon rotation of either the pump stem or a collar disposed about the pump stem. Others in the prior art have used various means to lock the pump stem in a depressed position by either rotation of the pump stem or a collar disposed about the pump stem.

U.S. Pat. No. 2,498,308 to Samuels et al relates to a sprayer having three positions of spray control. The three positions of spray control include a locked position, an intermittent or push-button position, and an automatic continuous position.

U.S. Pat. No. 3,500,761 to Clevenger et al discloses a reciprocable plunger hand pump having a floating sleeve slidable in a barrel and limited in axial movement relative to the plunger by a check valve integral with the sleeve. A liquid seal is established when the sleeve is wedged between the plunger and a collar whereat the valve closes liquid inlet orifices in the plunger by engagement with a seat. The collar has a skirt adapted to support a cover cap and shiftable to mount container caps of various top thicknesses.

U.S. Pat. No. 3,608,788 to Tanaka discloses a finger-operated atomizer pump for separating a liquid from a container. When a piston is pushed down or is pushed up by a resiliency of a coiled spring, a valve body is moved vertically to open or close a passage hole connecting an inner chamber of a cylinder and a central hole of the piston.

U.S. Pat. No. 3,729,120 to Sette discloses an aerosol having a stem for the actuation of a valve with a rotatable captive safety overcap. The overcap may be rotated, axially depressed, and rotated again with respect to said aerosol to operate the stem. When properly positioned to actuate the aerosol, the overcap is locked maintaining the aerosol in its spraying operation without attention, and the manipulation of the overcap must be reversed to stop the spray action.

U.S. Pat. No. 4,162,746 to Anderson discloses a liquid dispenser having a relatively rotatable closure, sleeve and plunger members. The plunger members could be locked against reciprocation of the plunger member by a misalignment between ribs and grooves therebetween.

U.S. Pat. No. 4,340,158 to Ford discloses a vent sealing lock down pump wherein a plunger may be locked down after a full depression stroke so that the overall height of the pump assembly and a container can be significantly reduced.

U.S. Pat. No. 4,960,230 to Marelli discloses a pump comprising a flexible ring piston within a chamber cooperating with a stem valve to enable or interrupt the outward flow of the fluid.

U.S. Pat. No. 4,991,746 to Schultz discloses an improved modular lotion pump having a rotatable locking sleeve for preventing accidental dispensing.

U.S. Pat. No. 5,000,347 to Tran discloses a pump for dispensing a protective fluid wherein a container is provided with a cap having a series of alignment bores for receiving tubular projections to enable reciprocation of the pump.

U.S. Pat. No. 5,025,9567 to Linsenbigler discloses a safety sprayer having a spray head being selectively locked in a first position and unlocked upon a 90 degree rotation of the spray head relative to an associated closure top.

Although the aforementioned prior references have contributed to the dispensing art, none of these prior art references has achieved the universal needs of the consumer. The manually operated pumps that lock in an extended position have the advantage of locking in the extended position after initial use without dispensing any product during the locking process. However, the manually operated pumps that lock in the extended position require larger shipping containers. Larger shipping containers may be desirable for distinctive products to enhances the desirability and appearance of the container of the product but are a distinct disadvantage for cost conscious products. The manually operated pumps that lock in the retracted position have the distinct disadvantage of dispensing liquid product during the locking process after the initial use of the pump.

Accordingly, none of the prior art references have provided a manually operated pump that solves the universal needs of being able to be locked in either the extended position or the retracted position.

Therefore, it is an object of this invention to provide a manually actuated pump for dispensing a liquid from a container that may be locked in either an extended or retracted position.

Another object of this invention is to provide a manually actuated pump for dispensing a liquid from a container that is easy to lock in either the extended position or the retracted position.

Another object of this invention is to provide a manually actuated pump for dispensing a liquid from a container wherein the sequence to lock the pump in the extended position is identical with the sequence to lock the pump in the retracted position.

Another object of this invention is to provide a manually actuated pump for dispensing a liquid within a container wherein the manually operated pump is simple to operate by the operator.

Another object of this invention is to provide a manually actuated pump for dispensing a liquid from a container that does not appreciably increase material cost of the manually operated pump.

Another object of this invention is to provide a manually actuated pump for dispensing a liquid from a container that is easy to assemble.

Another object of this invention is to provide a manually actuated pump for dispensing a liquid from a container that does not appreciably increase the overall cost of the pump.

Another object of this invention is to provide a manually actuated pump for dispensing a liquid from a container wherein the actuator remains aligned during actuation by an operator.

Another object of this invention is to provide a manually actuated pump for dispensing a liquid from a container wherein the actuator may be locked and unlocked with a rotation of the actuator of only ninety degrees.

Another object of this invention is to provide a manually actuated pump for dispensing a liquid from a container wherein the locking mechanism is internal the pump body to inhibit contamination from product residue and the like.

Another object of this invention is to provide a manually actuated pump for dispensing a liquid from a container wherein the manufacturer of the product has the option of shipping a product with the actuator in either the extended position or the retracted position.

The foregoing has outlined some of the more pertinent objects of the present invention. These objects should be construed as merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved manually actuated pump for dispensing a liquid within a container comprising a pump body having a first and a second body end with an internal pump cylinder extending therebetween. The pump body is secured to the container with an eduction tube being affixed to the second body end of the pump body for providing fluid communication between the liquid within the container and the internal pump cylinder of the pump body. A first one-way valve means enables the flow of the liquid only from the container into the internal pump cylinder of the pump body. A piston is slidably disposed within the internal pump cylinder of the pump body. A pump stem has a first and a second stem end with an internal stem passage extending therein. The first stem end is disposed external the pump body with the second stem end being disposed within the internal pump cylinder pump body. A spring biases the pump stem and the piston into an extended position. A second one-way valve means comprises the second stem end cooperating with the piston for enabling the flow of the liquid only from the internal pump cylinder into the internal stem passage of the pump stem. An actuator has a nozzle communicating with the internal stem passage of the pump stem for discharging the liquid from the container through the nozzle. The invention comprises locking means including a projection extending radially outward from the pump stem and an overhang extending radially inwardly relative to the internal pump cylinder of the pump body. The actuator is rotatable for rotating the projection of the pump stem out of alignment with the overhang for enabling the actuator to be moved from the extended position into a retracted position for pumping the liquid from the container for discharge from the nozzle. The actuator is rotatable in the extended position for rotating the projection of the pump stem into alignment with the overhang for preventing movement of the actuator. Furthermore, The actuator is rotatable in the depressed position for rotating the projection of the pump stem into alignment with the overhang for preventing movement of the actuator into the extended position.

In a more specific embodiment of the invention, the container has a container rim defining a container opening. The securing means comprises a flange extending radially outwardly from the pump body and a closure having a central opening for receiving the pump body therein enabling the closure to be affixed to the container for securing the flange into engagement with the closure rim.

The first one-way valve comprises a first valve seat defined in the pump body and a movable first valve member for sealing with the first valve seat whereby the spring biasing the first valve member into engagement with the first valve seat. In one embodiment of the invention, the movable first valve member comprises a ball valve for sealing with the first valve seat. The spring comprises a coil spring having a first portion, a second portion and an intermediate portion. The intermediate portion of the coil spring has a smaller diameter relative to the second portion of the coil spring for enabling the ball valve to be retained within second portion of the coil spring and to be biased into engagement with the first valve seat by the intermediate portion of the coil spring.

The second one-way valve means comprises the piston having a central opening defining a second valve seat and the pump stem having a stem valve surface. The spring biases the stem valve surface of the pump stem into engagement with the second valve seat of the piston for enabling the flow of the liquid only from the internal pump cylinder into the internal stem passage of the pump stem.

In a further example of the invention, the pump stem has an annular ridge defining a stem valve surface for movably retaining the piston on the pump stem. The internal stem passage terminates in a stem passage input orifice disposed adjacent the annular ridge of the pump stem. The stem valve surface of the pump stem is biased by the spring into engagement with the second valve seat of the piston for enabling the flow of the liquid only from the internal pump cylinder into the internal stem passage of the pump stem. The stem valve surface of the pump stem is displaced from the second valve seat of the piston for inhibiting the flow of the liquid between the internal pump cylinder and the internal stem passage of the pump stem upon movement of the actuator from the extended position into the retracted position for pumping the liquid from the internal pump cylinder of the pump body through the internal stem passage of the pump stem to be discharged from the nozzle.

In another embodiment of the invention, the overhang defines a first overhang surface and a second overhang surface. The actuator is rotatable in the extended position for rotating the projection of the pump stem into alignment with the first overhang surface of the overhang for preventing movement of the actuator in the extended position. The actuator is rotatable also in the retracted position for rotating the projection of the pump stem into alignment with the second overhang surface of the overhang for preventing movement of the actuator into the retracted position. The invention preferably includes first and second stop means cooperating with the first and second overhang surfaces for limiting the rotational movement of the pump stem.

Preferably, the locking means comprises a sleeve disposed in the internal pump cylinder of the pump body with the overhang extending radially inwardly from the sleeve. The overhang may comprise plural overhangs extending circumferentially about the sleeve defining a void therebetween. In this embodiment, the actuator is rotatable for rotating the projection of the pump stem out of alignment with the overhang and into alignment with the void for enabling the projection to pass through the void to permit the actuator to be moved from the extended position into a retracted position for pumping the liquid from the container for discharge from the nozzle;

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
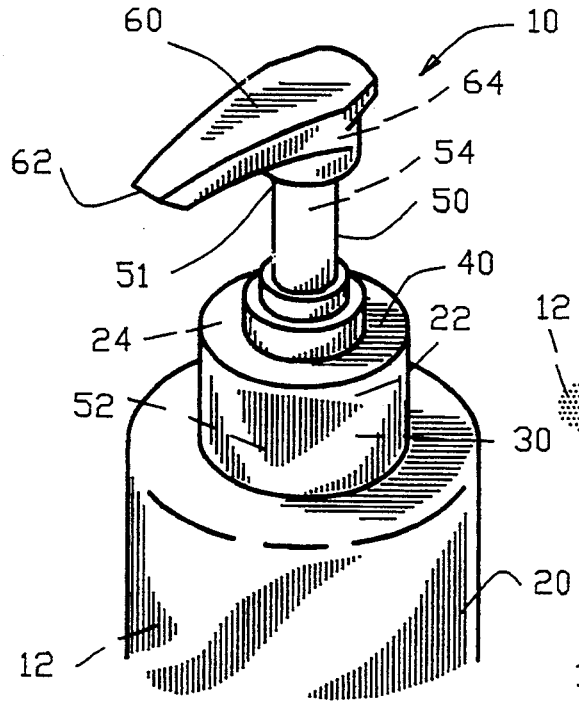
FIG. 1 is a partial isometric view of the improved manually actuated pump of the present invention secured to a container with an actuator located in an extended position.

FIG. 1 is a partial isometric view of the improved manually actuated pump 10 of the present invention for pumping a liquid 12 from a container 20. The container 20 comprises a container rim 22 defining a container opening 24 therein. The manually actuated pump 10 comprises a pump body 30 secured to the container 20 by a closure 40.

A pump stem 50 has a first stem end 51 extending external the pump body 30 and a second stem end 52 extending internal the pump body 30 with an internal stem passage 54 extending through the pump stem 50. The first stem end 51 supports an actuator 60 having a nozzle 62 for communicating with the internal stem passage 54 extending through the pump stem 50. The first stem end 51 is received within an actuator aperture 64 communicating with the nozzle 62 of the actuator 60. The actuator 60 is shown being located in an extended position relative to the container 20. Although the improved manually actuated pump 10 has been shown as a vertical action pump with a finger actuator, is should be understood that the present invention may be incorporated into a trigger pump of various configurations or other types of manually operated pumps.

Figure 2:
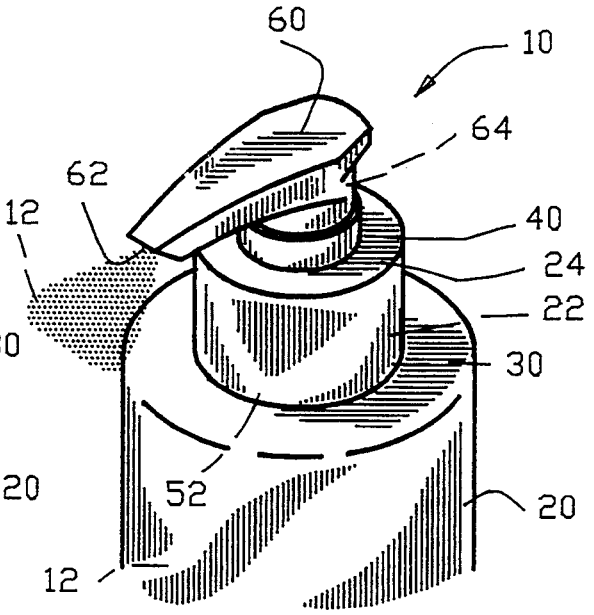
FIG. 2 is a partial isometric view of the improved manually actuated pump of FIG. 1 with the actuator located in a retracted position for dispensing liquid from the container.

FIG. 2 is a partial isometric view of the improved manually actuated pump of FIG. 1 with the actuator 60 located in a retracted position. As will be described in greater detail hereinafter, reciprocation of the actuator 60 between the extended position shown in FIG. 1 and the retracted position shown in FIG. 2 results in the pumping of the liquid 12 from the nozzle 62 for dispensing liquid 12 therefrom as shown in FIG. 2.

Figure 3:
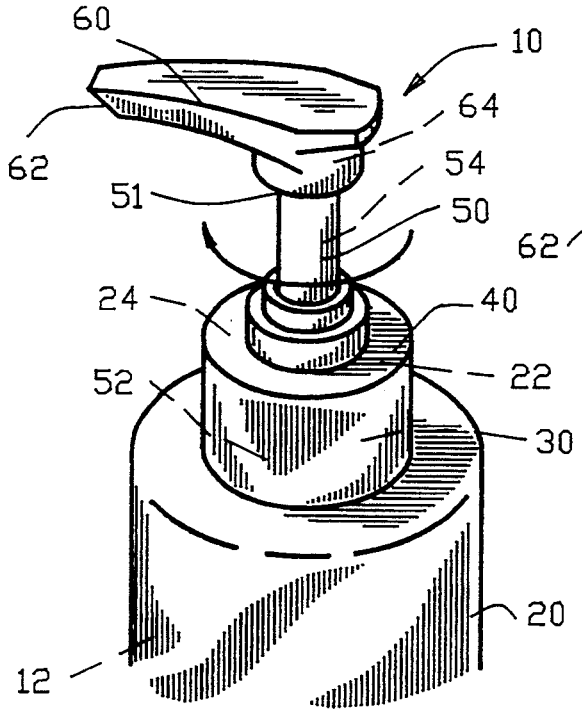
FIG. 3 is a partial isometric view of the improved manually actuated pump of FIGS. 1–2 with the actuator rotated to lock the actuator in the extended position.

FIG. 3 is a partial isometric view of the improved manually actuated pump 10 of FIGS. 1–2 with the actuator 60 being rotated to lock the actuator 60 in the extended position. In the extended locked position as shown in FIG. 3, the actuator 60 and the pump stem 50 are prevented from moving from the extended position to inhibit the pumping of the liquid 12 from the nozzle 62.

Figure 4:
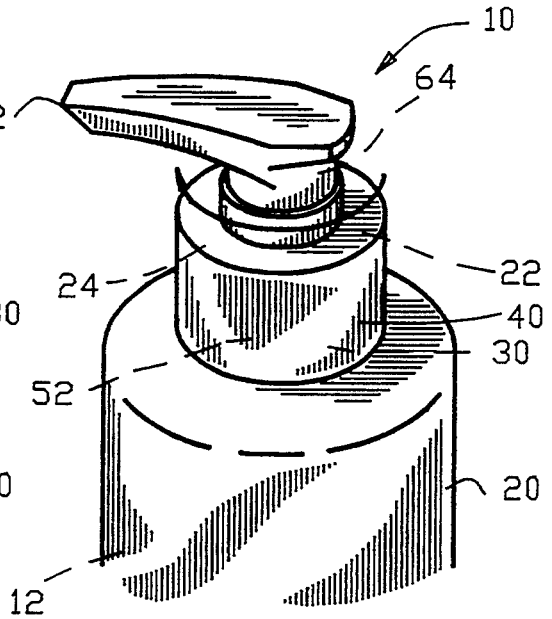
FIG. 4 is a partial isometric view of the improved manually actuated pump of FIGS. 1–2 with the actuator rotated to lock the actuator in the retracted position.

FIG. 4 is a partial isometric view of the improved manually actuated pump 10 of FIGS. 1–2 with the actuator 60 being rotated to lock the actuator 60 in the retracted position. In the retracted locked position as shown in FIG. 4, the actuator 60 and the pump stem 50 are prevented from moving from the retracted position to inhibit the pumping of the liquid 12 from the nozzle 62.

Figure 5:
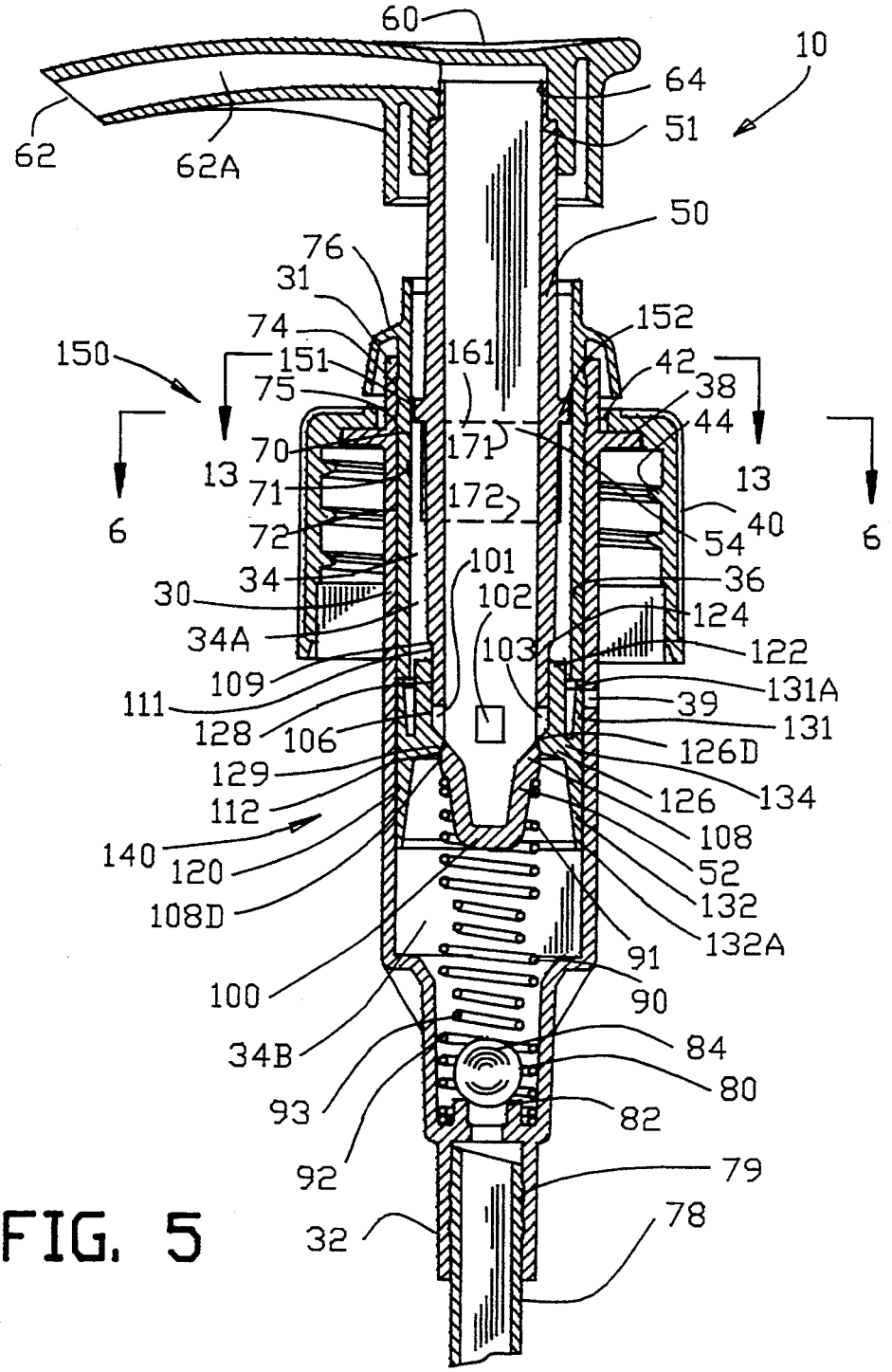
FIG. 5 is a side sectional view of the improved manually actuated pump of FIGS. 1–4 with the actuator located in the extended position.
Figure 6:
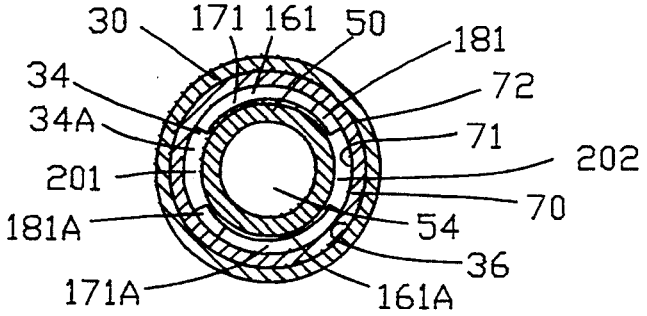
FIG. 6 is a sectional view along line 6—6 in FIG. 5.
Figure 7:
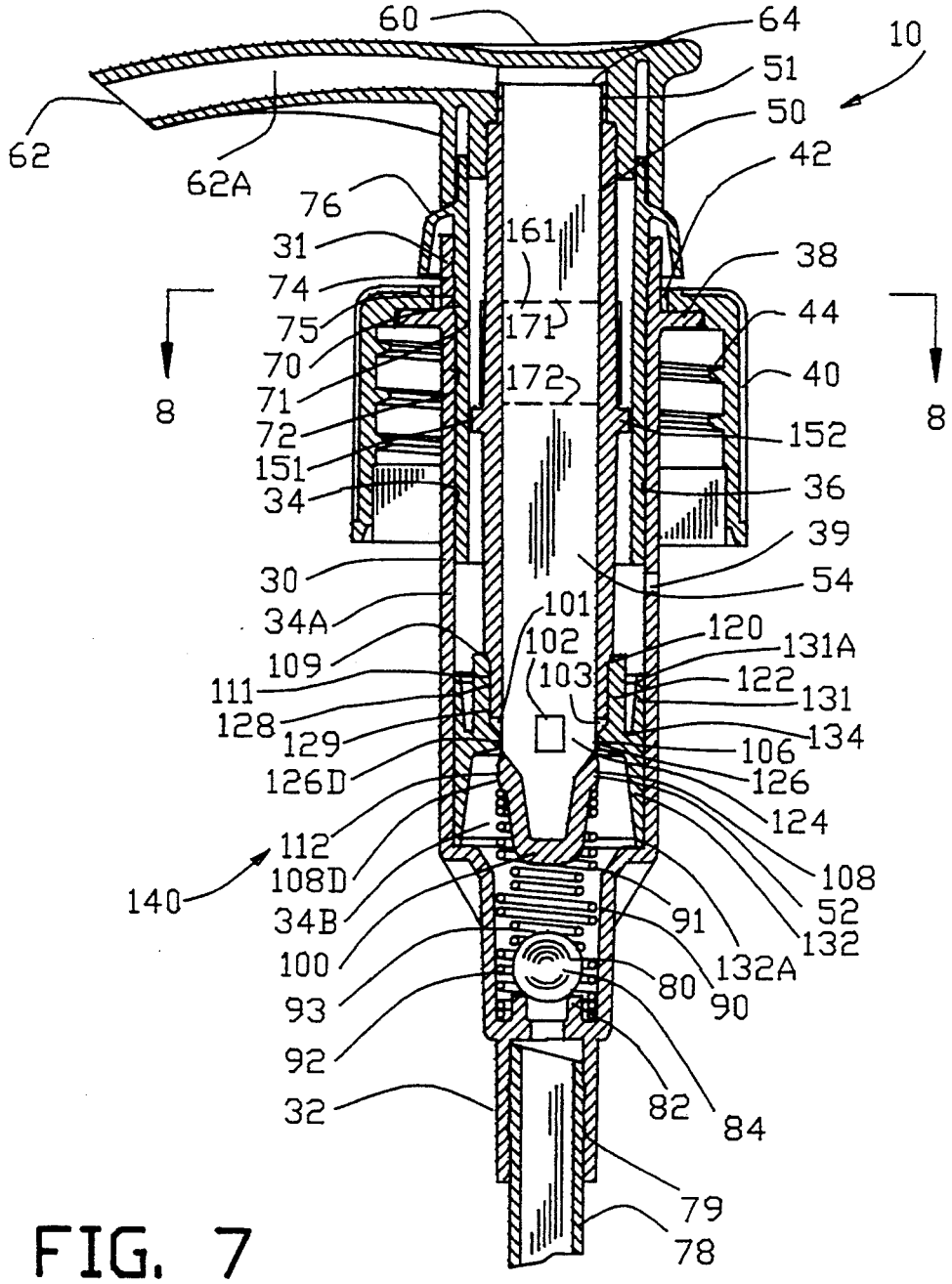
FIG. 7 is a side sectional view similar to FIG. 5 with the actuator located in the retracted position.
Figure 8:
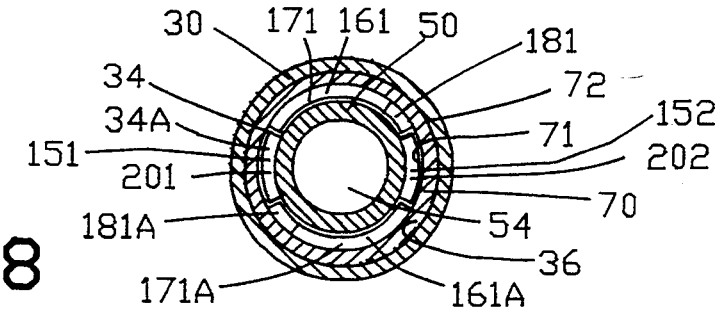
FIG. 8 is a sectional view along line 8—8 in FIG. 7.

FIG. 5 is a side sectional view of the improved manually actuated pump 10 of FIGS. 1–4 with the actuator 60 being located in the extended position. FIG. 6 is a sectional view along line 6—6 in FIG. 5. FIG. 7 is a side sectional view similar to FIG. 5 with the actuator located in the retracted position with FIG. 8 being a sectional view along line 8—8 in FIG. 7. The improved manually actuated pump 10 comprises the pump body 30 having a first and a second body end 31 and 32 with an internal pump cylinder 34 extending therebetween. The internal pump cylinder 34 defines an internal pump cylinder wall 36. The pump body 30 includes a radially outwardly extending flange 38 integrally molded with the pump body 30. A vent opening 39 extends through the internal pump cylinder wall 36 of the pump body 30.

A closure 40 defines a central opening 42 for enabling the first body end 31 of the pump body 30 to extend therethrough. The closure 40 is shown having closure threads 44 for securing with container threads (not shown) extending about the container rim 22 of the container 20 in a conventional fashion. The first body end 31 of the pump body 30 is received within the central opening 42 of the closure 40. The closure threads 44 of the closure 40 are affixable to the container threads (not shown) of the container 20 to secure the pump body 30 to the container 20. When the pump body 30 is secured to the container 20, the flange 38 of the pump body 30 engages with the container rim 22 of the container 20 to seal the pump body 30 to the container 20. Although the closure 40 has been shown attached to the container 20 through closure threads 44, it should be understood that various means may be utilized for securing the closure 40 to the container 20.

A sleeve 70 disposed within the internal pump cylinder 34 defines a sleeve internal cylinder wall 71. A sleeve external cylinder wall 72 is provided with sleeve clasps 74 for engaging with pump body clasps 75 defined in the internal pump cylinder wall 36 of the pump body 30 for securing the sleeve 70 within the pump body 30. A collar 76 is integrally secured to the sleeve 70 for overlaying the first body end 31 of the pump body 30. The collar 76 also retains the closure 40 between the flange 38 and the collar 76. The engagement of the sleeve clasps 74 with pump body clasps 75 is adjustable for accommodating closure 40 of various wall thickness.

An eduction tube 78 is frictionally secured into an eduction tube aperture 79 integrally molded into the second body end 32 of the pump body 30. The eduction tube 78 provides fluid communication between the liquid 12 within the container 20 and the internal pump cylinder 34 of the pump body 30.

A first one-way valve means 80 is located proximate the second body end 32 of the pump body 30 for enabling the flow of the liquid 12 only from the container 20 into the internal pump cylinder 34 of the pump body 30. The first one-way valve 80 comprises a valve seat 82 shown as a cylindrical valve seat integrally molded with the pump body 30. The first one-way valve means 80 includes a movable valve member 84 for sealing with the valve seat 82. In this embodiment of the invention, the valve member 84 is shown as a ball valve for sealing with the valve seat 82.

A spring 90 biases the valve member 84 into engagement with the valve seat 82. The spring 90 comprises a coil spring having a first portion 91, a second portion 92 and an intermediate portion 93. The intermediate portion 93 of the coil spring 90 has a smaller diameter relative to the second portion 92 of the coil spring 90. The second portion 92 of the spring 90 is sufficient in diameter to allow the valve member 84 to move linearly within the second portion 92 of the spring 90. The intermediate portion 93 of the spring 90 is sufficiently small in diameter to engage with the valve member 84. The second portion 92 of the spring 90 retains the valve member 84 within second portion 92 of the spring 90 while the intermediate portion 93 of the spring 90 biases the valve member 84 into sealing engagement with the valve seat 82.

The pump stem 50 extends between the first stem end 51 disposed external the pump body 30 and the second stem end 52 disposed internal the pump body 30. Preferably, the first stem end 51 is frictionally secured within the actuator aperture 64 for enabling fluid communication from the first stem end 51 to the nozzle 62 through a nozzle channel 62A. The second stem end 52 of the pump stem 50 defines a narrowed stem end 100 for receiving the first portion 91 of the spring 90 for biasing the pump stem 50 into the extended position. The internal stem passage 54 extends between the first stem end 51 and the second stem end 52 of the pump stem 50.

The internal stem passage 54 terminates in a plurality of stem passage input orifices including stem passage input orifices 101, 102 and 103 disposed in a stem recess 106 located proximate the second stem end 52 of the pump stem 50. The stem recess 106 is located between an annular stem ridge 108 defining a stem ridge diameter 108D and a stem shoulder 109. First and second stem valve seats 111 and 112 are defined in the pump stem 50. The first stem valve seat 111 is defined by the shoulder 109 of the pump stem 50. The second stem valve seat 112 is defined by the annular stem ridge 108.

A piston 120 is slidably disposed within the internal pump cylinder 34 of the pump body 30 thereby dividing the internal pump cylinder 34 into a first internal pump cylinder 34A and a second internal pump cylinder 34B. The piston 120 comprises a generally rigid cylindrical portion 122 defining a central opening 124. An annular piston ridge 126 extends inwardly into the central opening 124 and defines a piston ridge diameter 126D. A first and a second piston valve surface 128 and 129 are located on the piston for cooperating respectively with the first and second stem valve seats 111 and 112. The first piston valve surface 128 is defined by an inner surface of the generally rigid cylindrical portion 122 whereas the second piston valve surface 129 is defined by the annular piston ridge 126 of the piston 120.

A first and a second sealing skirt 131 and 132 are integrally formed with the piston 120 through an annular piston support 134. The first and second sealing skirts 131 and 132 are tapered as shown for enabling terminal ends 131A and 132A of the first and second sealing skirts 131 and 132 to frictionally engage with the internal pump cylinder wall 36 to form a slidable seal between piston 120 and the internal pump cylinder wall 36 of the internal pump cylinder 34.

The outer diameter of the stem ridge diameter 108D of the stem ridge 108 is slightly greater in diameter than the internal diameter of the piston ridge diameter 126D of the piston ridge 126. The slightly greater stem ridge diameter 108D relative to the piston ridge diameter 126D enables the stem ridge 108 to be forcefully inserted into the central opening 124 of the piston 120 and passed through the piston ridge 126. The forceful insertion of the stem ridge 108 into the central opening 124 of the piston 120 deforms the generally rigid cylindrical portion 122 of the piston 120 enabling the stem ridge 108 to be forced passed the piston ridge 126. Upon the stem ridge 108 being forced passed the piston ridge 126, the piston 120 is slidably retained within the stem recess 106 of the pump stem 50.

A second one-way valve means 140 comprises the first and second stem valve seats 111 and 112 of the pump stem 50 cooperating with the first and second piston valve surfaces 128 and 129 of the piston 120. The piston 120 being slidable within the stem recess 106 of the pump stem 50 enables the first and second stem valve seats 111 and 112 of the pump stem 50 to engage respectively, the first and second piston valve surfaces 128 and 129 of the piston 120. As the piston 120 slides within the stem recess 106 of the pump stem 50, the piston 120 can either cover or expose the stem passage input orifices 101–103 for opening and closing fluid communication into the internal stem passage 54 of the pump stem 50. The first piston valve surface 128 of the piston 120 forms a sliding seal with the first stem valve seats 111.

In the unattended position as shown FIG. 5, the spring 90 biases the second stem valve seat 112 of the pump stem 50 into engagement with the second piston valve surface 129 of the piston 120 for inhibiting the flow of the liquid 12 from the second internal pump cylinder 34B into the internal stem passage 54 of the pump stem 50. When the actuator 60 is moved by an operator toward the retracted position as shown in FIG. 7, the frictionally engagement between the terminal ends 131A and 132A of the first and second sealing skirts 131 and 132 and the internal pump cylinder wall 36 initially immobilizes the piston 120 relative to the pump body 30. As the pump stem 50 moves relative to the piston 120, the second stem valve seat 112 of the pump stem 50 is displaced from the second piston valve surface 129 of the piston 120 for enabling the flow of the liquid 12 between the second internal pump cylinder 34B and the internal stem passage 54 of the pump stem 50. Continued movement of the pump stem 50 relative to the piston 120 results in the first stem valve seat 111 of the pump stem 50 slidably sealing with the first piston valve surface 128 of the piston 120 for inhibiting the flow of the liquid 12 from the second internal pump cylinder 34B into the first internal pump cylinder 34A.

When the actuator 60 is released by an operator, the spring 90 moves the pump stem 50 toward the extended position as shown in FIG. 5. The frictionally engagement between the terminal ends 131A and 132A of the first and second sealing skirts 131 and 132 and the internal pump cylinder wall 36 again initially immobilizes the piston 120 relative to the pump body 30. As the pump stem 50 moves relative to the piston 120, the first stem valve seat 111 of the pump stem 50 slidably seals with the first piston valve surface 128 of the piston 120 for inhibiting the flow of the liquid 12 between the second internal pump cylinder 34B and the internal stem passage 54 of the pump stem 50. Continued movement of the pump stem 50 relative to the piston 120 results in the second stem valve seat 112 of the pump stem 50 being moved into engagement with the second piston valve surface 129 of the piston 120 as shown in FIG. 5 for inhibiting the flow of the liquid 12 from the second internal pump cylinder 34B into the internal stem passage 54.

Figure 9:
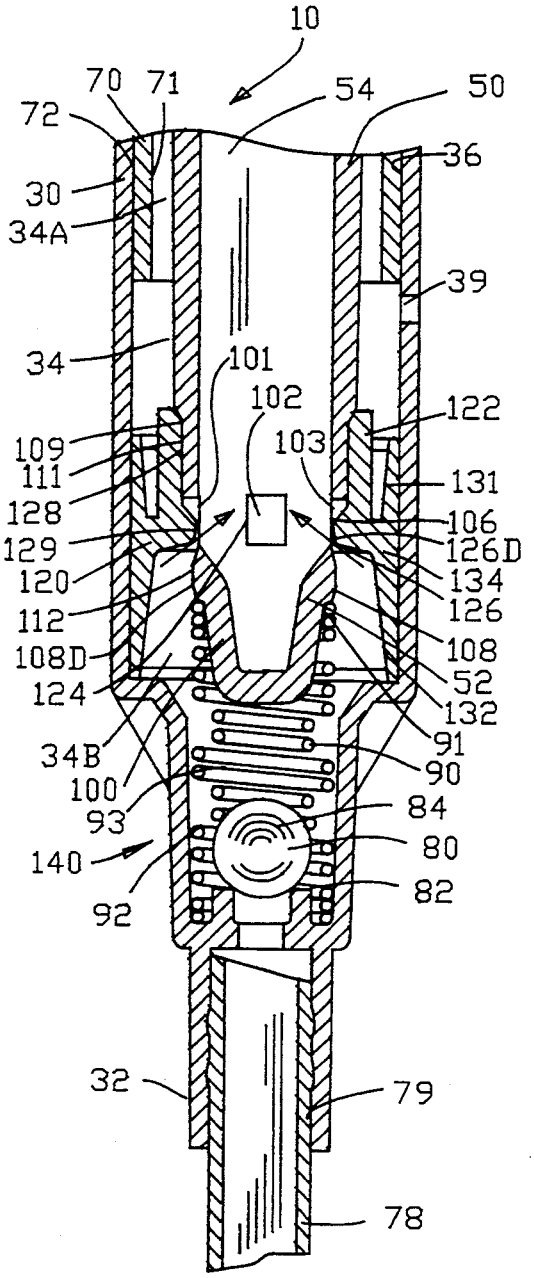
FIG. 9 is an enlarged partial side sectional view of the improved manually actuated pump of FIGS. 1–4 with the actuator being move into the retracted position.
Figure 10:
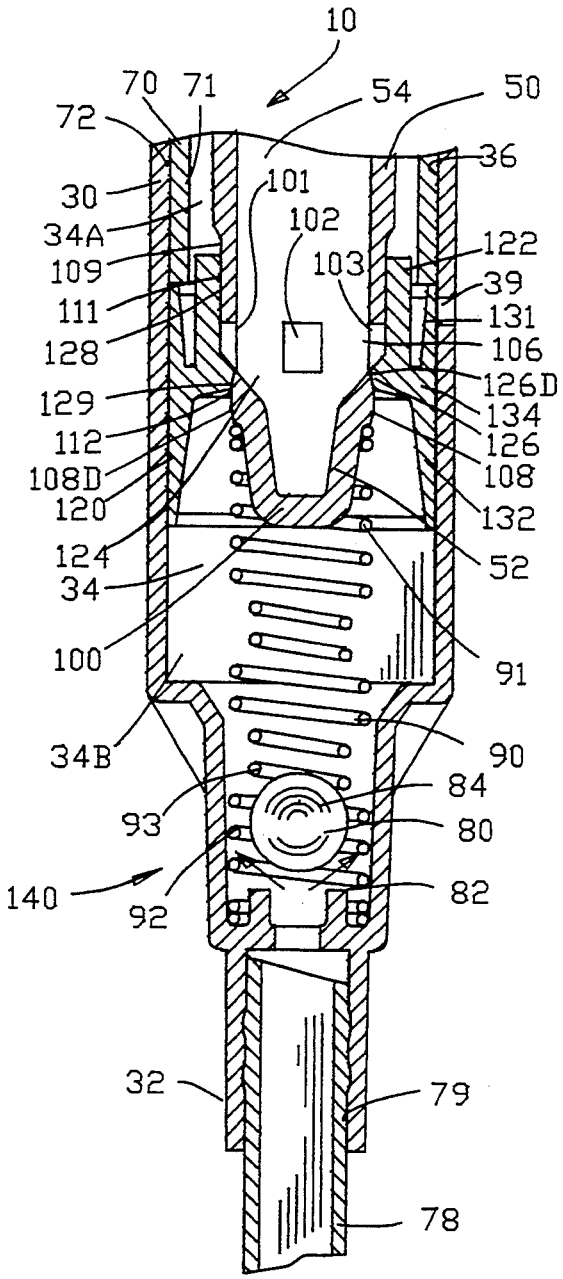
FIG. 10 is an enlarged partial side sectional view of the improved manually actuated pump of FIGS. 1–4 with the actuator being returned into the extended position.

FIGS. 9 and 10 illustrate the pumping operation of the improved manually actuated pump 10 of the present invention. FIG. 9 illustrates the pump stem 50 moving toward the second body end 32 of the pump body 30 by the external force of an operator whereas FIG. 10 illustrates the pump stem 50 returning toward the first body end 31 of the pump body 30 by action of the spring 90.

As the actuator 60 is depressed by an operator, the pump stem 50 moves toward the second body end 32 of the pump body 30 and the pump stem 50 moves relative to the piston 120. The second stem valve seat 112 is displaced from the second piston valve surface 129 for opening the stem passage input orifices 101–103 and the first stem valve seat 111 maintains the slidable seal with the first piston valve surface 128 to inhibit the flow of the liquid 12 from the second internal pump cylinder 34B into the first internal pump cylinder 34A. The first one-way valve means 80 remains in the closed position with the movable valve member 84 sealing with the valve seat 82.

The movement of the pump stem 50 toward the second body end 32 of the pump body 30 reduces the volume of the second internal pump cylinder 34B to pump any liquid 12 within the second internal pump cylinder 34B into the internal stem passage 54 of the pump stem 50 as shown by the arrows in FIG. 9. The liquid 12 is pumped to the first stem end 51 and through the nozzle channel 62A for discharge from the nozzle 60.

When the pump stem 50 is moved toward the second body end 32 of the pump body 30, the piston 120 uncovers the vent opening 39 extending through the internal pump cylinder wall 36 of the pump body 30. The vent opening 39 enables the venting of the container 20 from the ambient along a channel between the pump stem 50 and the internal pump cylinder wall 36.

FIG. 10 illustrates the pump stem 50 returning toward the first body end 31 of the pump body 30 by action of the spring 90. As the actuator 60 is returned by the spring 90, the pump stem 50 moves toward the first body end 31 of the pump body 30 and the pump stem 50 moves relative to the piston 120. The first stem valve seat 111 maintains a sliding seal with the first piston valve surface 128 and closes the stem passage input orifices 101–103. The second stem valve seat 112 moves into engagement with the second piston valve surface 129 to inhibit the flow of the liquid 12 from the second internal pump cylinder 34B into the internal stem passage 54 of the pump stem 50. As the movement of the pump stem 50 continues, the piston 120 covers the vent opening 39 extending through the internal pump cylinder wall 36 of the pump body 30.

The movement of the pump stem 50 toward the first body end 31 of the pump body 30 increases the volume of the second internal pump cylinder 34B to reduce the internal pressure therein. The reduced internal pressure in the second internal pump cylinder 34B moves the movable valve member 84 out of sealing engagement with the valve seat 82 to open the first one-way valve means 80. The opened first one-way valve means 80 enables the liquid 12 within the container 20 to pass through the eduction tube 78 to enter the second internal pump cylinder 34B as shown by the arrows in FIG. 10.

The improved manually actuated pump 10 includes locking means 150 for locking the actuator 60 in the extended position as shown in FIG. 3 and for locking the actuator 60 in the retracted position as shown in FIG. 4. The locking means 150 comprises a projection shown as first and second projections 151 and 151A extending radially outwardly from the pump stem 50. The locking means 150 further comprises an overhang shown as first and second sleeve overhangs 161 and 161A extending radially inwardly relative to the internal pump cylinder 34 of the pump body 30. In this embodiment of the invention, first and second sleeve overhangs 161 and 161A extend radially inwardly from the sleeve internal cylinder wall 71 of the internal sleeve 70.

Figure 11:
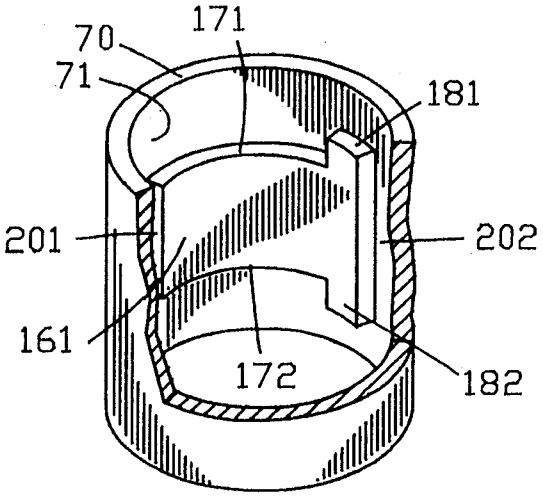
FIG. 11 is a partial cut away isometric view of a portion of sleeve shown in FIG. 6 illustrating an overhang and stops.

FIG. 11 is a partial cut away isometric view of a portion of the internal sleeve 70 shown in FIG. 6 illustrating the first sleeve overhang 161 with the second sleeve overhang 161A being a mirror image thereof. The first sleeve overhang 161 defines a first and a second overhang surface 171 and 172. Each of the first and second sleeve overhangs 161 and 161A extends circumferentially through an angle of approximately 90 degrees about the internal sleeve 70. A first and a second void 201 and 202 is defined between the first and second sleeve overhangs 161 and 161A.

First stops 181 and 181A extend radially inwardly and axially toward the first body end 31 of the pump body 30 for limiting the rotation of the pump stem 50 when the actuator 60 is in the extended position. Second stops 182 and 182A extend radially inwardly and axially toward the second body end 32 of the pump body 30 for limiting the rotation of the pump stem 50 when the actuator 60 is in the retracted position.

Figure 12:
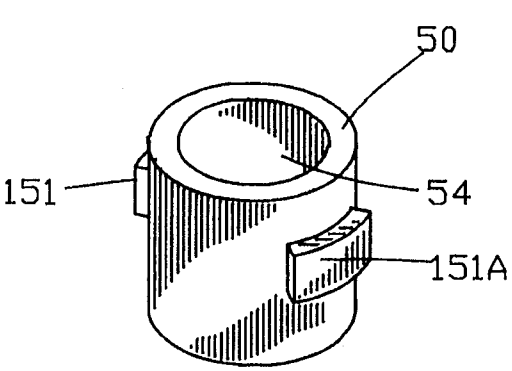
FIG. 12 is a partial cut away isometric view of a portion of a pump stem of FIG. 6 illustrating projections.

FIG. 12 is a partial cut away isometric view of a portion of a pump stem 50 of FIG. 6 illustrating the first and second projections 151 and 151A extending radially outwardly from the pump stem 50. The first and second projections 151 and 151A are established to pass through the first and second voids 201 and 202 to circumvent the first and second overhangs 161 and 161A.

Figure 15:
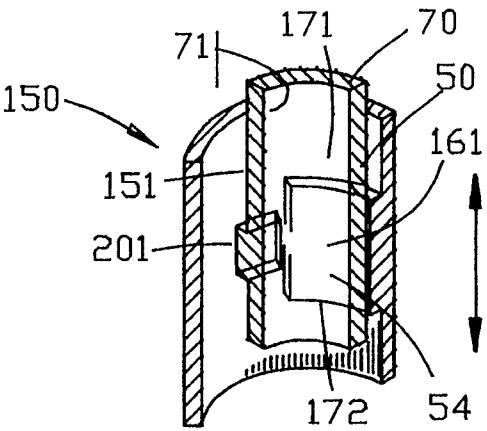
FIG. 15 is a partial cut away isometric downward view of FIG. 13 illustrating the position of the first projection relative to the overhang.
Figure 14:
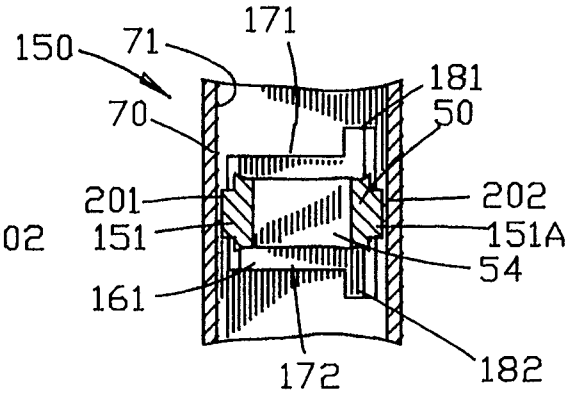
FIG. 14 is a sectional view along line 14—14 in FIG. 13 illustrating the position of the projection relative to the overhang.
Figure 13:
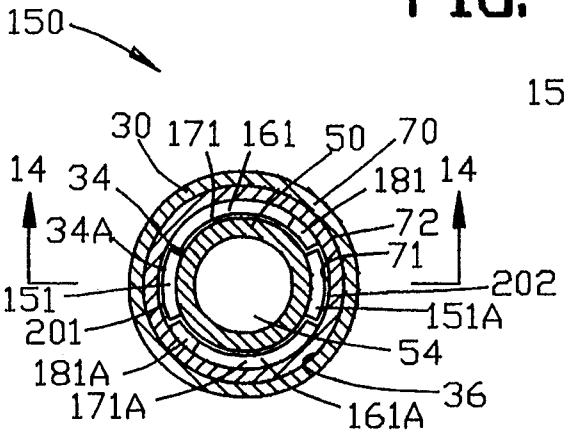
FIG. 13 is a sectional view along line 13—13 in FIG. 5 with the pump stem located in an operative position for enabling dispensing of the liquid from the container.

FIG. 13 is a sectional view along line 13—13 in FIG. 5 with the pump stem 50 being located in an operative position for enabling dispensing of the liquid 12 from the container 20. FIG. 14 is a sectional view along line 14—14 in FIG. 13 whereas FIG. 15 is a partial cut away isometric downward view of FIG. 13.

The actuator 60 is shown rotated with the first and second projection 151 and 151A of the pump stem 50 out of alignment with the first and second sleeve overhangs 161 and 161A. The first and second projections 151 and 151A are shown aligned with the first and second void 201 and 202 for enabling the first and second projections 151 and 151A to pass through the first and second voids 201 and 202, respectively. In this position of rotation of the actuator 60, the pump stem 50 may be reciprocated between the extended position and the retracted position for pumping the liquid 12 from the container 20 through the nozzle 62.

Figure 18:
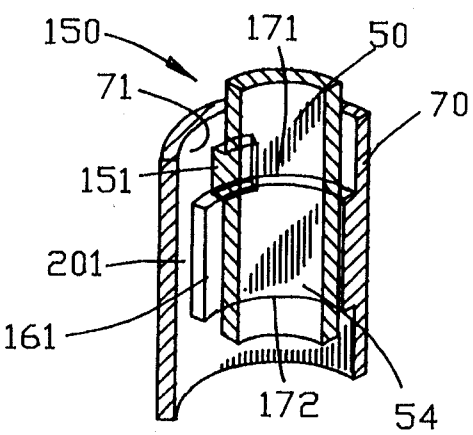
FIG. 18 is a partial cut away isometric downward view of FIG. 16 illustrating the position of the first projection relative to the overhang.
Figure 17:
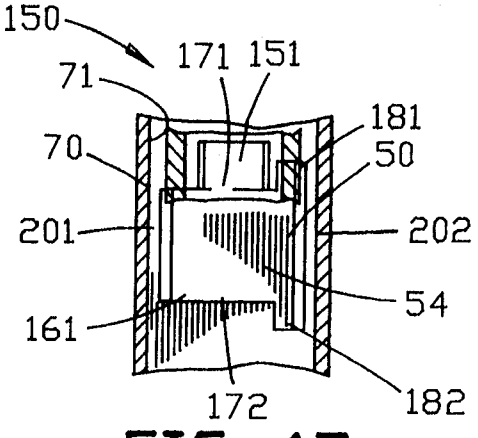
FIG. 17 is a sectional view along line 17—17 in FIG. 16 illustrating the position of the projection relative to the overhang.
Figure 16:
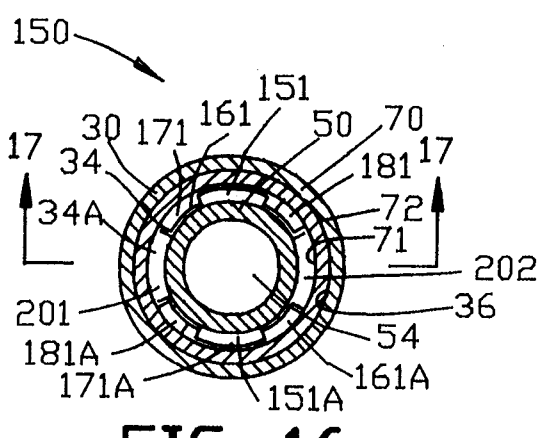
FIG. 16 is a sectional view similar to FIG. 13 with the pump stem locked in the extended position.

FIG. 16 is a sectional view similar to FIG. 13 with the pump stem 50 being locked in the extended position for preventing movement of the actuator 60. FIG. 17 is a sectional view along line 17—17 in FIG. 16 whereas FIG. 18 is a partial cut away isometric downward view of FIG. 16.

The actuator 60 is shown rotated in the extended position with the first and second projection 151 and 151A of the pump stem 50 in alignment with the first and second sleeve overhangs 161 and 161A. The first and second projections 151 and 151A are shown in alignment with the first overhang surfaces 171 and 171A for preventing movement of the actuator 60 toward the second body end 32 of the pump body 30. The first stops 181 and 181A limit a clockwise rotational movement in FIG. 16 upon the first and second projection 151 and 151A of the pump stem 50 respectively contacting the first stops 181 and 181A. The first and second projection 151 and 151A of the pump stem 50 are shown displaced from the first stops 181 and 181A for the sake of clarity in the various FIGS. of the drawings.

When an operator desires to return the improved manually actuated pump 10 into the operative position shown in FIGS. 13–15, the actuator 60 is rotated counterclockwise in FIG. 16 to return to the operating position as shown in FIGS. 13–15. The first and second projections 151 and 151A of the pump stem 50 respectively contact the first stops 181A and 181 to limit the counterclockwise rotation of the pump stem 50 and to align the first and second projections 151 and 151A with the first and second void 201 and 202. When the first and second projections 151 and 151A are aligned with the first and second void 201 and 202, the first and second projections 151 and 151A to pass through the first and second voids 201 and 202 for enabling the pump stem 50 to be reciprocated for pumping the liquid 12 from the container 20 through the nozzle 62.

Figure 21:
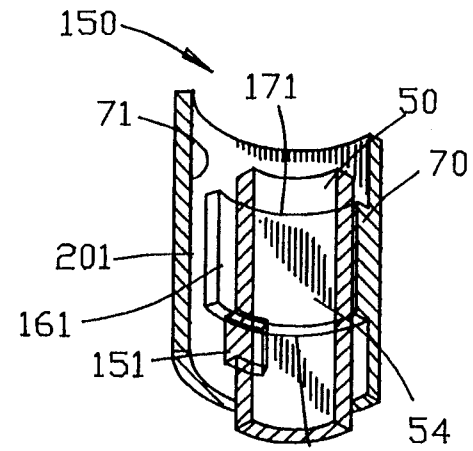
FIG. 21 is a partial cut away isometric upward view of FIG. 19 illustrating the position of the projection relative to the overhang.
Figure 20:
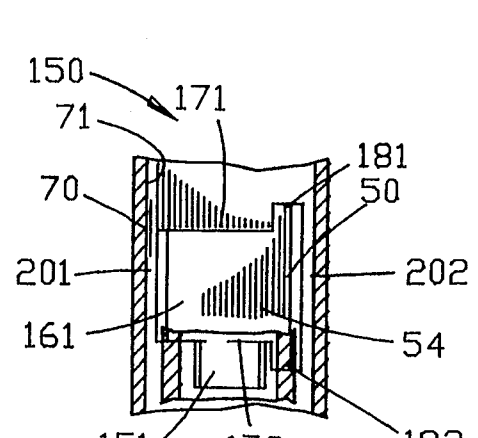
FIG. 20 is a sectional view along line 20—20 in FIG. 19 illustrating the position of the projection relative to the overhang.
Figure 19:
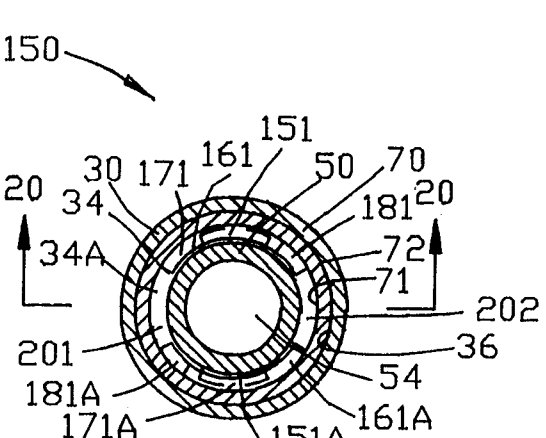
FIG. 19 is a sectional view similar to FIG. 13 with the pump stem locked in the retracted position.

FIG. 19 is a sectional view similar to FIG. 13 with the pump stem 50 being locked in the retracted position for preventing movement of the actuator 60. FIG. 20 is a sectional view along line 20—20 in FIG. 19 whereas FIG. 21 is a partial cut away isometric upward view of FIG. 19.

The actuator 60 is shown rotated in the retracted position with the first and second projection 151 and 151A of the pump stem 50 in alignment with the first and second overhangs 161 and 162. The first and second projections 151 and 151A are shown in alignment with the second overhang surfaces 172 and 172A for preventing movement of the actuator 60 toward the first body end 31 of the pump body 30. The second stops 182 and 182A limit a clockwise rotational movement in FIGS. 16–18 upon the first and second projection 151 and 151A of the pump stem 50 respectively contacting the second stops 182 and 182A.

When an operator desires to return the improved manually actuated pump 10 into the operative position shown in FIGS. 13–15, the actuator 60 is rotated counterclockwise in FIG. 19 to return to the operating position shown in FIGS. 13–15. The first and second projections 151 and 151A of the pump stem 50 respectively contact the second stops 182A and 182 to limit the counterclockwise rotation of the pump stem 50 and to align the first and second projections 151 and 151A with the first and second void 201 and 202. When the first and second projections 151 and 151A are aligned with the first and second void 201 and 202, the first and second projections 151 and 151A to pass through the first and second voids 201 and 202 for enabling the pump stem 50 to be reciprocated for pumping the liquid 12 from the container 20 through the nozzle 62.

The improved manually actuated pump of the present invention provides a pump that is easy to lock in either the extended position or the retracted position. The sequence of locking the improved pump in the extended position is identical with the sequence to lock the improved pump in the retracted position. The actuator remains aligned during operation and may be locked and unlocked with a rotation of the actuator of only ninety degrees in contrast to threaded locking pumps of the prior art. The locking mechanism is internal to the pump body to inhibit contamination from product residue and the like.

The number of the component parts of the improved manually actuated pump is small to reduce the material cost of the manually operated pump. The small number of component parts facilitates the assembly of the improved pump and does not appreciably increase the overall cost of the pump.

The pump may be sealed and shipped by a manufacturer in either the extended locked position or the retracted locked position. The improved manually actuated pump may be then relocked and sealed in the extended position or the retracted position by the operator. An improved manually actuated pump is suitable for dispensing a wide variety of liquid including lotions, creams and the like.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved manually actuated pump for dispensing a product disposed within a container, comprising in combination:

a pump body having a first and a second body end with an internal pump cylinder extending therebetween;

securing means for securing said pump body to the container;

an eduction tube affixed to said second body end of said pump body for providing fluid communication between the product within the container and said internal pump cylinder of said pump body;

first one-way valve means for enabling the flow of the product only from the container into said internal pump cylinder of said pump body;

a piston slidably disposed within said internal pump cylinder of said pump body;

said piston including an actuator stem having a first and a second stem end with an internal stem passage extending therein;

said first stem end terminating in a terminal orifice disposed external said pump body with said second stem end being disposed within said internal pump cylinder of said pump body;

a spring extending for biasing said piston into an extended position;

second one-way valve means for enabling the flow of the product only from said internal pump cylinder into said internal stem passage of said actuator stem;

locking means comprising a projection and an overhang;

one of said projection and said overhang extending radially outwardly from said actuator stem the other of said projection and said overhang extending radially inwardly in relation to said pump body;

said actuator stem being rotatable for rotating said one of said projection and said overhang out of alignment with said other of said projection and said overhang for enabling said actuator stem to be moved from said extended position into a retracted position for pumping the product from the container to discharge from said terminal orifice;

said actuator stem being rotatable in said extended position for rotating said one of said projection and said overhang into alignment with said other of said projection and said overhang for preventing movement of said actuator stem into said retracted position; and said actuator stem being rotatable in said retracted position for rotating said one of said projection and said overhang into alignment with said other of said projection and said overhang for preventing movement of said actuator stem into said extended position.

2. An improved manually actuated pump as set forth in claim 1, wherein the container has a container rim defining a container opening;

said securing means comprises a flange extending radially outwardly from said pump body; and a closure having a central opening for receiving said pump body therein enabling said closure to be affixed to said container for securing said flange into engagement with said closure rim.

3. An improved manually actuated pump as set forth in claim 1, wherein said first one-way valve comprises a first valve seat defined in said pump body;

a movable first valve member for sealing with said first valve seat; and said spring biasing said first valve member into engagement with said first valve seat.

4. An improved manually actuated pump as set forth in claim 1, wherein said first one-way valve comprises a first valve seat defined in said pump body;

a movable first valve member comprising a ball valve for sealing with said first valve seat;

said spring comprising a coil spring having a first portion, a second portion and an intermediate portion;

said intermediate portion of said coil spring having a smaller diameter relative to said second portion of said coil spring for enabling said ball valve to be retained within second portion of said coil spring and to be biased into engagement with said first valve seat by said intermediate portion of said coil spring.

5. An improved manually actuated pump as set forth in claim 1, wherein second one-way valve means comprises said piston having a central opening defining a second valve seat;

said actuator stem having a stem valve surface; and said spring biasing said stem valve surface of said actuator stem into engagement with said second valve seat of said piston for enabling the flow of the liquid only from said internal pump cylinder into said internal stem passage of said actuator stem.

6. An improved manually actuated pump as set forth in claim 1, wherein said overhang defines a first overhang surface and a second overhang surface;

said actuator stem being rotatable in said extended position for rotating said projection into alignment with said first overhang surface of said overhang for preventing movement of said actuator stem from said extended position; and said actuator stem being rotatable in said retracted position for rotating said projection into alignment with said second overhang surface of said overhang for preventing movement of said actuator stem from said retracted position.

7. An improved manually actuated pump as set forth in claim 1, wherein said overhang defines a first overhang surface and a second overhang surface;

said actuator stem being rotatable in said extended position for rotating said projection into alignment with said first overhang surface of said overhang for preventing movement of said actuator stem from said extended position;

said actuator stem being rotatable in said retracted position for rotating said projection into alignment with said second overhang surface of said overhang for preventing movement of said actuator stem from said retracted position; and first and second stop means cooperating with said first and second overhang surfaces for limiting the rotational movement of said pump stem.

8. An improved manually actuated pump as set forth in claim 1, wherein said overhang defines a first overhang surface and a second overhang surface;

said actuator stem being rotatable in said extended position for rotating said projection into alignment with said first overhang surface of said overhang for preventing movement of said actuator stem from said extended position;

said actuator stem being rotatable in said retracted position for rotating said projection into alignment with said second overhang surface of said overhang for preventing movement of said actuator stem from said retracted position;

first and second stop means cooperating with said first and second overhang surfaces for limiting the rotational movement of said pump stem;

said first stop means extending radially inwardly and axially toward said first body end of said pump body for limiting the rotation of said pump stem when said actuator stem is in said extended position;

said second stop means extending radially inwardly and axially toward said second body end of said pump body for limiting the rotation of said pump stem when said actuator stem is in said retracted position;

said projection engaging said one of said first stop means when said actuator stem is in said extended position for limiting the rotation of said pump stem in a first direction of rotation;

said projections engaging the other of said first stop means when said actuator stem is in said extended position for limiting the rotation of said pump stem in a second direction of rotation;

said projection engaging said one of said second stop means when said actuator stem is in said retracted position for limiting the rotation of said pump stem in said first direction of rotation; and said projections engaging the other of said second stop means when said actuator stem is in said retracted position for limiting the rotation of said pump stem in said second direction of rotation.

9. An improved manually actuated pump as set forth in claim 1, wherein said locking means comprises a sleeve disposed in said internal pump cylinder of said pump body with said overhang extending radially inwardly from said sleeve.

10. An improved manually actuated pump as set forth in claim 1, wherein said overhang comprises a sleeve disposed in said internal pump cylinder of said pump body with said overhang including plural overhangs extending circumferentially about said sleeve defining a void therebetween; and said actuator stem being rotatable for rotating said projection on said pump stem out of alignment with said overhang and into alignment with said void for enabling said projection to pass through said void to permit said actuator stem to be moved from said extended position into a retracted position for pumping the liquid from the container for discharge from said terminal orifice.

11. An improved manually actuated pump as set forth in claim 1, wherein said overhang comprises plural overhangs with each of said overhangs extending circumferentially through an angle of approximately 90 degrees.

12. An improved manually actuated pump for dispensing a liquid within a container, comprising in combination:

a pump body having a first and a second body end with an internal pump cylinder extending therebetween;

securing means for securing said pump body to the container;

an eduction tube affixed to said second body end of said pump body for providing fluid communication between the liquid within the container and said internal pump cylinder of said pump body;

first one-way valve means for enabling the flow of the liquid only from the container into said internal pump cylinder of said pump body;

a piston slidably disposed within said internal pump cylinder of said pump body;

a pump stem having a first and a second stem end with an internal stem passage extending therein;

said first stem end being disposed external said pump body with said second stem end being disposed within said internal pump cylinder pump body;

a spring extending for biasing said pump stem and said piston into an extended position;

second one-way valve means comprising said second stem end cooperating with said piston for enabling the flow of the liquid only from said internal pump cylinder into said internal stem passage of said pump stem;

an actuator having a nozzle communicating with said internal stem passage of said pump stem for discharging the liquid from the container through said terminal orifice;

locking means comprising a projection extending radially outward from said pump stem and an overhang extending radially inwardly from said internal pump cylinder of said pump body;

said actuator being rotatable for rotating said projection of said pump stem out of alignment with said overhang for enabling said actuator to be moved from said extended position into a retracted position for pumping the liquid from the container for discharge from said nozzle;

said actuator being rotatable in said extended position for rotating said projection of said pump stem into alignment with said overhang for preventing movement of said actuator;

said actuator being rotatable in said retracted position for rotating said protection of said pump stem into alignment with said overhang for preventing movement of said actuator;

said second one-way valve means comprising said piston having a central opening defining a second valve seat;

said pump stem having an annular ridge defining a stem valve surface for movably retaining said piston on said pump stem;

said internal stem passage terminating in a stem passage input orifice disposed adjacent said annular ridge of said pump stem;

said stem valve surface of said pump stem being biased by said spring into engagement with said second valve seat of said piston for enabling the flow of the liquid only from said internal pump cylinder into said internal stem passage of said pump stem; and said stem valve surface of said pump stem being displaced from said second valve seat of said piston for inhibiting the flow of the liquid between said internal pump cylinder and said internal stem passage of said pump stem upon movement of said actuator from said extended position into said retracted position for pumping the liquid from the internal pump cylinder of said pump body through said internal stem passage of said pump stem to be discharged from said nozzle.

13. An improved manually actuated pump for dispensing a product disposed within a container, comprising in combination:

a pump body having a first and a second body end with an internal pump cylinder extending therebetween;

securing means for securing said pump body to the container;

an eduction tube affixed to said second body end of said pump body for providing fluid communication between the product within the container and said internal pump cylinder of said pump body;

first one-way valve means for enabling the flow of the product only from the container into said internal pump cylinder of said pump body;

a piston slidably disposed within said internal pump cylinder of said pump body;

said piston including an actuator stem having a first and a second stem end with an internal stem passage extending therein;

said first stem end terminating in a terminal orifice disposed external said pump body with said second stem end being disposed within said internal pump cylinder of said pump body;

a spring extending for biasing said piston into an extended position;

second one-way valve means for enabling the flow of the product only from said internal pump cylinder into said internal stem passage of said actuator stem;

locking means comprising a projection and an overhang;

a sleeve disposed in said internal pump cylinder of said pump body;

one of said projection and said overhang extending radially outwardly from said actuator stem the other of said projection and said overhang extending radially inwardly from said sleeve;

said actuator stem being rotatable for rotating said one of said projection and said overhang out of alignment with said other of said projection and said overhang for enabling said actuator stem to be moved from said extended position into a retracted position for pumping the product from the container to discharge from said terminal orifice;

said actuator stem being rotatable in said extended position for rotating said one of said projection and said overhang into alignment with said other of said projection and said overhang for preventing movement of said actuator stem into said retracted position; and said actuator stem being rotatable in said retracted position for rotating said one of said projection and said overhang into alignment with said other of said projection and said overhang for preventing movement of said actuator stem into said extended position.

14. In a manually actuated pump for dispensing a product disposed within a container, the pump comprising a pump body having an internal pump cylinder with a piston including an actuator stem slidably disposed within said internal pump cylinder, the actuator stem having an internal stem passage terminating in a terminal orifice disposed external said pump body, a first one-way valve means for enabling the flow of the product from a container into the internal pump cylinder and a second one-way valve means for enabling the flow of the product from the internal pump cylinder into the internal stem passage, with a spring biasing the piston ,into an extended position for enabling the actuator stem to be longitudinally moved between the extended position and a retracted position for pumping the product from the container for discharge from the terminal orifice:

the improvement comprising:

a sleeve disposed in said internal pump cylinder of said pump body;

locking means comprising a projection and an overhang with one of said projection and said overhang extending radially outwardly from said actuator stem the other of said projection and said overhang extending radially inwardly from said sleeve;

said actuator stem being rotatable for rotating said one of said projection and said overhang out of alignment with said other of said projection and said overhang for enabling said actuator stem to be moved from said extended position into a retracted position for pumping the product from the container for discharge from said terminal orifice;

said actuator stem being rotatable in said extended position for rotating said one of said projection and said overhang into alignment with said other of said projection and said overhang for preventing movement of said actuator stem into said retracted position; and said actuator stem being rotatable in said retracted position for rotating said one of said projection and said overhang into alignment with said other of said projection and said overhang for preventing movement of said actuator stem into said extended position.

15. An improved manually actuated pump as set forth in claim 14, wherein said overhang defines a first overhang surface and a second overhang surface;

said actuator stem being rotatable in said extended position for rotating said projection of said pump stem into alignment with said first overhang surface of said overhang for preventing movement of said actuator stem in said extended position; and said actuator stem being rotatable in said retracted position for rotating said projection of said pump stem into alignment with said second overhang surface of said overhang for preventing movement of said actuator stem into said retracted position.

16. An improved manually actuated pump as set forth in claim 14, wherein said overhang defines a first overhang surface and a second overhang surface;

said actuator stem being rotatable in said extended position for rotating said projection of said pump stem into alignment with said first overhang surface of said overhang for preventing movement of said actuator stem in said extended position;

said actuator stem being rotatable in said retracted position for rotating said projection of said pump stem into alignment with said second overhang surface of said overhang for preventing movement of said actuator stem into said retracted position; and first and second stop means cooperating with said first and second overhang surfaces for limiting the rotational movement of said pump stem.

17. An improved manually actuated pump as set forth in claim 14, wherein said overhang defines a first overhang surface and a second overhang surface;

said actuator stem being rotatable in said extended position for rotating said projection of said pump stem into alignment with said first overhang surface of said overhang for preventing movement of said actuator stem from said extended position;

said actuator stem being rotatable in said retracted position for rotating said projection of said pump stem into alignment with said second overhang surface of said overhang for preventing movement of said actuator stem from said retracted position;

first and second plural stop means cooperating with said first and second overhang surfaces for limiting the rotational movement of said pump stem;

said first plural stop means extending radially inwardly and axially toward said first body end of said pump body for limiting the rotation of said pump stem when said actuator stem is in said extended position;

said second plural stop means extending radially inwardly and axially toward said second body end of said pump body for limiting the rotation of said pump stem when said actuator stem is in said retracted position;

said projection engaging said one of said first means when said actuator stem is in said extended position for limiting the rotation of said pump stem in a first direction of rotation;

said projections engaging the other of said first means when said actuator stem is in said extended position for limiting the rotation of said pump stem in a second direction of rotation;

said projection engaging said one of said second means when said actuator stem is in said retracted position for limiting the rotation of said pump stem in said first direction of rotation; and said projections engaging the other of said second means when said actuator stem is in said retracted position for limiting the rotation of said pump stem in said second direction of rotation.

18. An improved manually actuated pump as set forth in claim 14, wherein said overhang comprises plural overhangs extending circumferentially about said sleeve defining a void therebetween; and said actuator stem being rotatable for rotating said projection of said pump stem out of alignment with said overhang and into alignment with said void for enabling said projection to pass through said void to permit said actuator stem to be moved from said extended position into a retracted position for pumping the liquid from the container for discharge from said terminal orifice.

19. An improved manually actuated pump as set forth in claim 14, wherein said overhang comprises plural overhangs with each of said overhangs extending circumferentially through an angle of approximately 90 degrees.

* * * * *

US005405057C1

(12) EX PARTE REEXAMINATION CERTIFICATE (5690th)

United States Patent
Moore

(10) Number: US 5,405,057 C1
(45) Certificate Issued: Mar. 6, 2007

(54) MANUALLY ACTUATED PUMP

(75) Inventor: David G. Moore, Roach, MO (US)

(73) Assignee: Seaquistperfect Dispensing Foreign, Inc., Crystal Lake, IL (US)

Reexamination Request:
No. 90/006,884, Dec. 10, 2003

Reexamination Certificate for:

| | |
|---|---|
| Patent No.: | **5,405,057** |
| Issued: | **Apr. 11, 1995** |
| Appl. No.: | **08/139,168** |
| Filed: | **Oct. 21, 1993** |

(51) Int. Cl.
*B67D 5/00* (2006.01)

(52) U.S. Cl. ..... 222/153.14; 222/153.13; 222/321.9

(58) Field of Classification Search ..... 222/153.13, 222/153.14, 321, 384; 239/333
See application file for complete search history.

(56) References Cited

U.S. PATENT DOCUMENTS 2,846,124 A 8/1958 Stewart et al.
4,369,899 A 1/1983 Magers et al.
4,538,748 A 9/1985 Ford et al.
5,405,057 A 4/1995 Moore

FOREIGN PATENT DOCUMENTS

GB 2122692 1/1984

*Primary Examiner*—Joseph A. Kaufman

(57) ABSTRACT

An apparatus is disclosed for an improved manually actuated pump for dispensing a liquid within a container comprising a pump body having an internal pump cylinder secured to the container. A piston is slidably disposed within the internal pump cylinder of the pump body with a pump stem having a stem end extending external the pump body. The stem end supports an actuator having a nozzle communicating with an internal stem passage of the pump stem for discharging the liquid from the container through the nozzle. A lock comprises a projection extending radially outward from the pump stem and an overhang extending radially inwardly relative to the internal pump cylinder of the pump body for preventing movement of the actuator in either an extended position or a retracted position upon rotation of the pump stem.

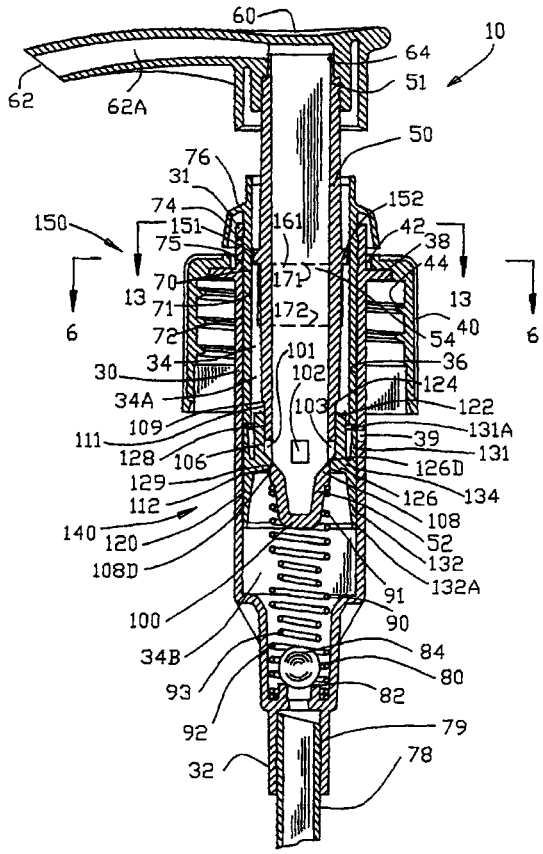

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3, 4 and 12 is confirmed.

Claims 1, 2, 5–11 and 13–19 are cancelled.

* * * * *